US006028262A

United States Patent [19]

Minamitaka

[11] Patent Number: 6,028,262

[45] Date of Patent: Feb. 22, 2000

[54] EVOLUTION-BASED MUSIC COMPOSER

[75] Inventor: Junichi Minamitaka, Musashimurayama, Japan

[73] Assignee: Casio Computer Co., Ltd., Tokyo, Japan

[21] Appl. No.: 09/243,696

[22] Filed: Feb. 3, 1999

[30] Foreign Application Priority Data

Feb. 10, 1998 [JP] Japan ..... 10-043013

[51] Int. Cl.[7] ..... G10H 1/40; G10H 7/00

[52] U.S. Cl. ..... 84/611; 84/635

[58] Field of Search ..... 84/611, 635, 651, 84/667

[56] References Cited

U.S. PATENT DOCUMENTS 4,926,737 5/1990 Minamitaka .

5,418,323 5/1995 Kohonen ..... 84/609

5,606,144 2/1997 Dabby ..... 84/609

*Primary Examiner*—Jeffrey Donels

*Attorney, Agent, or Firm*—Frishauf, Holtz, Goodman, Langer & Chick, P. C.

[57] ABSTRACT

An apparatus and method for composing a musical rhythm whereby an initial generation rhythm population having a plurality of individual rhythms is provided, and a new generation rhythm population is repeatedly generated from a preceding generation rhythm population, beginning with the initial generation rhythm population. In order to evolve the rhythm populations, individual rhythms of a rhythm population of interest are evaluated according to a predetermined evaluating function to thereby determine a rhythm valuation, and genetic operations are performed on the rhythm population of interest in a manner such that the rhythm valuation will generally increase with each new generation rhythm population. The evolving operation is stopped when a predetermined terminating condition is met.

12 Claims, 18 Drawing Sheets

FIG.16

| | | | |
|---|---|---|---|
| points [ 0 ][ ] | 16 | 8 | 16 |
| points [ 1 ][ ] | 2 | 4 | 1 |
| mpoints [ 0 ][ ] | 1 | 2 | 4 |
| mpoints [ 1 ][ ] | 16 | 8 | 16 |

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| dat [ 0 ][ 0 ][ ] | 2a70 | 2a70 | 2a70 | 2a70 | 2a70 | 2a70 | 2a70 | 2a70 | 2a70 | 2a70 | 2a70 | 2a70 | 2a70 | 2a70 | 2a70 | 2a70 |
| wave [0～15] | 112 | 0 | 112 | 0 | 112 | 0 | 112 | 0 | 112 | 0 | 112 | 0 | 112 | 0 | 112 | 0 |
| wave [16～31] | 112 | 0 | 112 | 0 | 112 | 0 | 112 | 0 | 112 | 0 | 112 | 0 | 112 | 0 | 112 | 0 |
| spec [1～15] | | 0 | 0 | 0 | 0 | 0 | 0 | 0 | 0 | 0 | 0 | 0 | 0 | 0 | 0 | 0 |
| spec [16～31] | 71. 3 | 0 | 0 | 0 | 0 | 0 | 0 | 0 | 0 | 0 | 0 | 0 | 0 | 0 | 0 | 0 |

val0 spec[ 16 ]+spec[ 8 ]+spec [ 16 ] - spec [ 1 ] - spec [ 2 ] - spec [ 4 ] = 142. 6

| | | | | | | | | | | | | | | | | |
|---|---|---|---|---|---|---|---|---|---|---|---|---|---|---|---|---|
| dat [ 0 ][ 1 ][ ] | 2470 | 2401 | 2401 | 2801 | 2870 | 2401 | 2470 | 2470 | 2470 | 2801 | 2401 | 2401 | 2870 | 2401 | 2801 | 2470 |
| wave [0～15] | 112 | 0 | 1 | 0 | 1 | 0 | 1 | 0 | 112 | 0 | 1 | 0 | 112 | 0 | 112 | 0 |
| wave [16～31] | 112 | 0 | 1 | 0 | 1 | 0 | 1 | 0 | 112 | 0 | 1 | 0 | 1 | 0 | 112 | 0 |
| spec [1～15] | | 6. 9 | 19. 3 | 6. 8 | 24. 4 | 6. 7 | 9. 6 | 6. 4 | 18. 7 | 6. 1 | 8. 7 | 5. 7 | 19. 6 | 5. 2 | 13. 9 | 4. 7 |
| spec [16～31] | 31. 6 | 4. 1 | 10. 8 | 3. 6 | 11. 8 | 3 | 3. 9 | 2. 4 | 6. 2 | 1. 8 | 2. 2 | 1. 2 | 3. 5 | 0. 7 | 1. 3 | 0. 2 |

val1 spec[ 2 ]+spec[ 4 ]+spec[ 1 ] - spec[ 16 ] - spec[ 8 ] - spec[ 16 ] = 19. 3+24. 4+6. 9 - 31. 6 - 18. 7 - 31.6 = -31. 3 val val0 + val1 = 111. 3

FIG.18

| | | | | | | | | | | | | | | | | |
|---|---|---|---|---|---|---|---|---|---|---|---|---|---|---|---|---|
| phase [ ] | 0 | 8 | | | | | | | | | | | | | | |
| mpase [ ] | 1 | 5 | | | | | | | | | | | | | | |
| phase-rate | 0-2 | | | | | | | | | | | | | | | |
| | 0 | 1 | 2 | 3 | 4 | 5 | 6 | 7 | 8 | 9 | 10 | 11 | 12 | 13 | 14 | 15 |
| pase_pat [ ] | 2 | 0 | 1 | 0 | 2 | 0 | 1 | 0 | 2 | 0 | 1 | 0 | 1 | 0 | 1 | 0 |
| dat [ 0 ][ 0 ][ ] | 2a70 | 2a70 | 2a70 | 2a70 | 2a70 | 2a70 | 2a70 | 2a70 | 2a70 | 2a70 | 2a70 | 2a70 | 2a70 | 2a70 | 2a70 | 2a70 |
| wave [0～15] | 112 | 0 | 112 | 0 | 112 | 0 | 112 | 0 | 112 | 0 | 112 | 0 | 112 | 0 | 112 | 0 |
| wave [16～31] | 112 | 0 | 112 | 0 | 112 | 0 | 112 | 0 | 112 | 0 | 112 | 0 | 112 | 0 | 112 | 0 |
| val 0 | 143 | | | | | | | | | | | | | | | |
| dat [ 0 ][ 1 ][ ] | 2470 | 2401 | 2401 | 2801 | 2870 | 2401 | 2470 | 2470 | 2470 | 2801 | 2401 | 2401 | 2870 | 2401 | 2801 | 2470 |
| wave [0～15] | 112 | 0 | 1 | 0 | 1 | 0 | 1 | 0 | 112 | 0 | 1 | 0 | 112 | 0 | 112 | 0 |
| wave [16～31] | 112 | 0 | 1 | 0 | 1 | 0 | 1 | 0 | 112 | 0 | 1 | 0 | 1 | 0 | 112 | 0 |
| val 1 | -11 | | | | | | | | | | | | | | | |
| val | 131 | | | | | | | | | | | | | | | |

EVOLUTION-BASED MUSIC COMPOSER

BACKGROUND OF THE INVENTION

The present invention relates to computer-based music apparatus and systems for music composition, and in particular to rhythm composers for automatically composing musical rhythms.

A rhythm composer is known which uses control data to modify a given or source rhythm. For instance, U.S. Pat. No. 4,926,737 of the present inventor and assigned to the present assignee, discloses a rhythm composer which uses a pulse scale as control data. The pulse scale is a pattern of weights of timings or pulse points on a music time axis. A weight of a particular timing or pulse point may be regarded as representative of the number of notes that can be generated at that pulse point, or representative of the chances of generation of a note at that point. Such a pulse scale is used to join notes or disjoin a note. In a particular mode of joining or disjoining notes, the rhythm composer finds a note that starts at a minimum weight pulse point and joins it to the preceding note, or finds a note that includes midway a pulse point of the maximum weight and disjoins it into two notes, using that pulse point as the disjoining point.

Whereas the prior art rhythm composers can automatically compose rhythms using control data, their process of rhythm modification is completely or essentially deterministic for a given rhythm and control data (pulse scale). Thus, the rhythm composing capability of the prior art rhythm composer is limited.

SUMMARY OF THE INVENTION

Therefore, it is an object of the invention to provide a music apparatus and method which takes a new and unique approach to the problem of rhythm composition.

Another object of the invention is to provide a music apparatus which can efficiently compose desired rhythms in accordance with a method of biological evolution involving stochastic processes.

In accordance with the invention, there is provided an apparatus for composing a musical rhythm of music which comprises:

(A) initial rhythm generation providing an initial generation rhythm population comprising means for providing a plurality of individual rhythms;

(B) rhythm evolving means for repeatedly generating a new generation rhythm population from a preceding generation rhythm population, beginning with the initial generation;

(C) the rhythm evolving means comprising (i) rhythm evaluating means for evaluating the individual rhythms of a rhythm population of interest according to a predetermined evaluating function to thereby determine a rhythm valuation thereof, and (ii) genetic operations means for performing genetic operations on the rhythm population of interest so that the rhythm valuation will generally increase with each new generation rhythm population; and (D) stopping means for stopping the operation of the rhythm evolving means when a predetermined terminating condition is met.

With this arrangement, each generation of rhythm populations undergoes genetic operations (e.g., selection, crossover, mutation) such that the rhythm valuation will generally get higher with generations changing from older to newer so that the rhythm population will experience desired evolution through a number of generations. Thus, the arrangement can efficiently compose such rhythms as having a desired rhythm valuation. In addition, it can provide an open and wide space of rhythm composition since the genetic operations on the rhythm population are not deterministic but involve stochastic processes.

In an embodiment, the genetic operations means comprises rhythm crossover means for exchanging individual segments between rhythm rhythms of the rhythm population of interest. It may further comprise rhythm replacing means for receiving the resultant rhythm population from the rhythm crossover means and for replacing a individual rhythms having a lower valuation with individual rhythms having of a higher valuation. Since those individual rhythms having a lower valuation have been rejected from the next generation, the population rhythm valuation will generally increase.

In the alternative or in combination with the replacing means, a selection control means may be provided. The selection control means controls selective crossover frequency of individual rhythms of the rhythm population of interest in such a manner that individual rhythms are selected to undergo crossover at such a frequency as depends on respective rhythm valuations thereof. With the selection control, those individual rhythms of a generation having the highest rhythm valuations get the highest chances of spreading out their genes (elements of rhythm) into the next generation. Thus, the population rhythm valuation tends to increase through new generations. The genetic operations means comprises mutation means for mutating an element of an individual rhythm. The stopping means may comprise means for stopping the operation of the rhythm evaluating means when the rhythm valuation of the rhythm population of interest has exceeded a predetermined value.

In the alternative, the stopping means may stop the operation of the rhythm evolving means when it has repeated the genetic operations a predetermined number of times.

In an embodiment, the rhythm evaluating means comprises:

(a) conditioning means for setting a condition of rhythm evaluation; and (b) calculating means for using the set condition to calculate rhythm valuations of the individual rhythms.

In an embodiment, the rhythm evaluating means takes the form of a spectrum evaluating means for analyzing the contents of a rhythm of interest so as to evaluate a frequency fitness thereof. In the alternative or in combination, a phase evaluating means may be provided which evaluates a phase fitness of a rhythm of interest. A combination of a frequency fitness valuation and a phase fitness valuation may be used as representative of a net fitness valuation of the rhythm.

The invention further provides a method for automatically composing a musical rhythm, which comprises:

(A) a providing step of providing an initial generation rhythm population comprising a plurality of individual rhythms;

(B) an evolving step of repeatedly generating a new generation rhythm population from a preceding generation rhythm population beginning with the initial generation;

(C) the evolving step comprising (i) evaluating the individual rhythms of a rhythm population of interest according to a predetermined evaluating function to thereby determine a rhythm valuation thereof, and (ii) performing genetic operations on the rhythm population of interest so that the rhythm valuation will generally increase with each new generation rhythm population; and (D) a stopping step of stopping the evolving step when a predetermined terminating condition is met.

Another aspect of the invention provides a method for automatically composing a musical rhythm which comprises:

(A) a providing step of providing an initial generation rhythm population comprising a plurality of individual rhythms;

(B) a conditioning step of providing conditioning parameters;

(C) an evaluating step of evaluating the fitness of individual rhythms of a rhythm population of interest based on said conditioning parameters;

(D) a genetic step of performing genetic operations on the rhythm population of interest (starting with the initial generation) based on results of said evaluating to thereby generate a new generation rhythm population; and (E) a repeating step of repeating the evaluating step and genetic step until a predetermined terminating condition is met.

It may be preferred that all individual rhythms of the rhythm population have the same length for facilitation of genetic operations, such as rhythm crossing over. This is not, however, limitative. If desired, genetic operations may involve changing (e.g., lengthening) the length of individual rhythms of the rhythm population.

BRIEF DESCRIPTION OF THE DRAWINGS

The above and other objects and advantages of the invention will become more apparent from the following description taking in conjunction with the accompanying drawings in which:

FIG. 16 illustrates spectrum fitness valuations of rhythms obtained as a result of the routine in FIG. 15;

FIG. 18 illustrate phase fitness valuations of rhythms obtained as a result of the routine in FIG. 17.

DETAILED DESCRIPTION OF PREFERRED EMBODIMENTS

The invention will be described in more detail with respect to the preferred embodiments.

Figure 1:
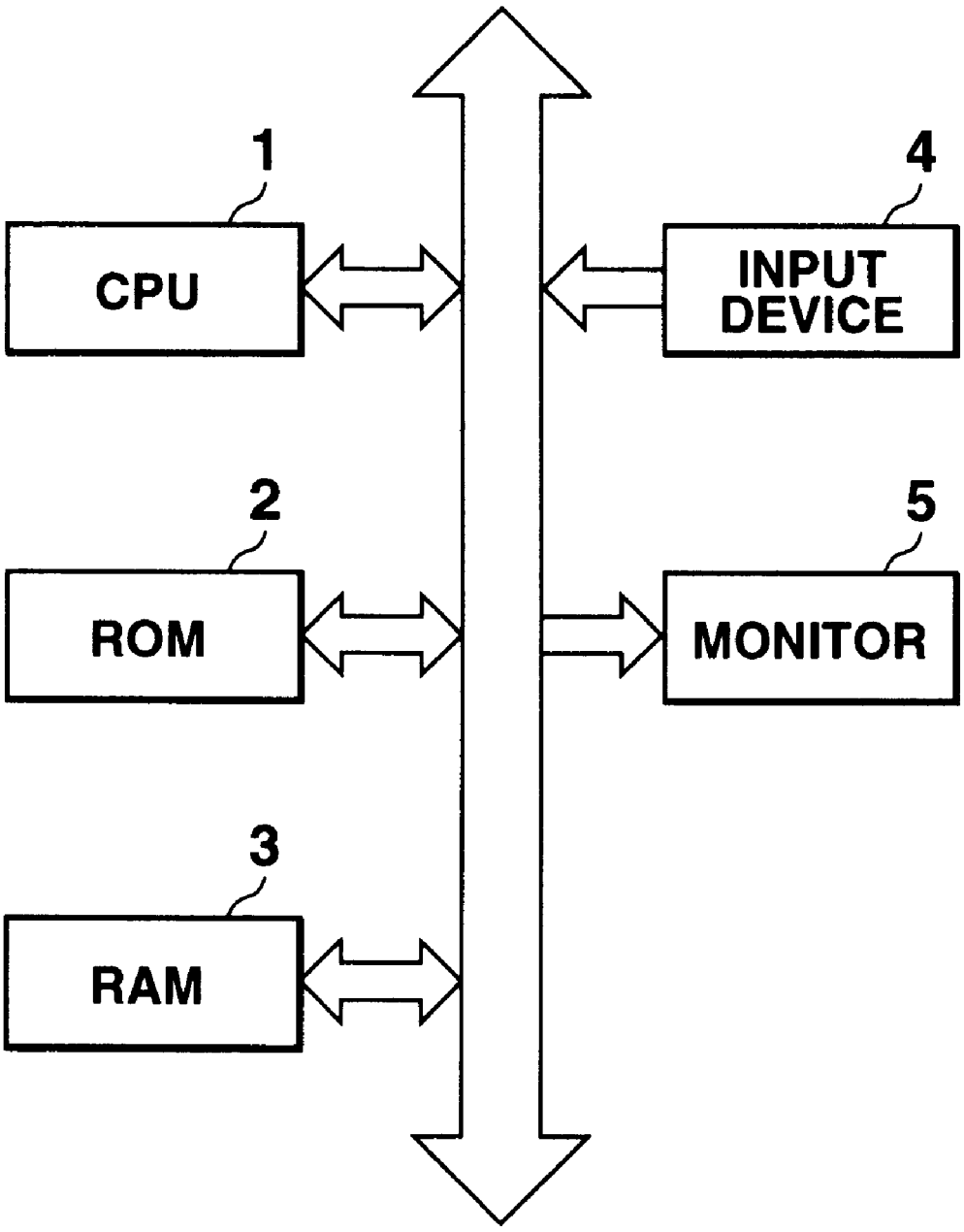
FIG. 1 is a block diagram of a hardware arrangement of a rhythm composer to which the invention can be applied.

FIG. 1 shows a hardware arrangement of a rhythm composer of the invention.

CPU 1 controls the system so as to function as a rhythm composer of the invention. ROM 2 stores programs and fixed data. RAM 3 stores data entered and those in process. A input device 4 is used to enter parameters required for rhythm composition. A monitor 5 is used to display data, messages and information, such as result of the rhythm composition and guide for input operation.

Figure 2:
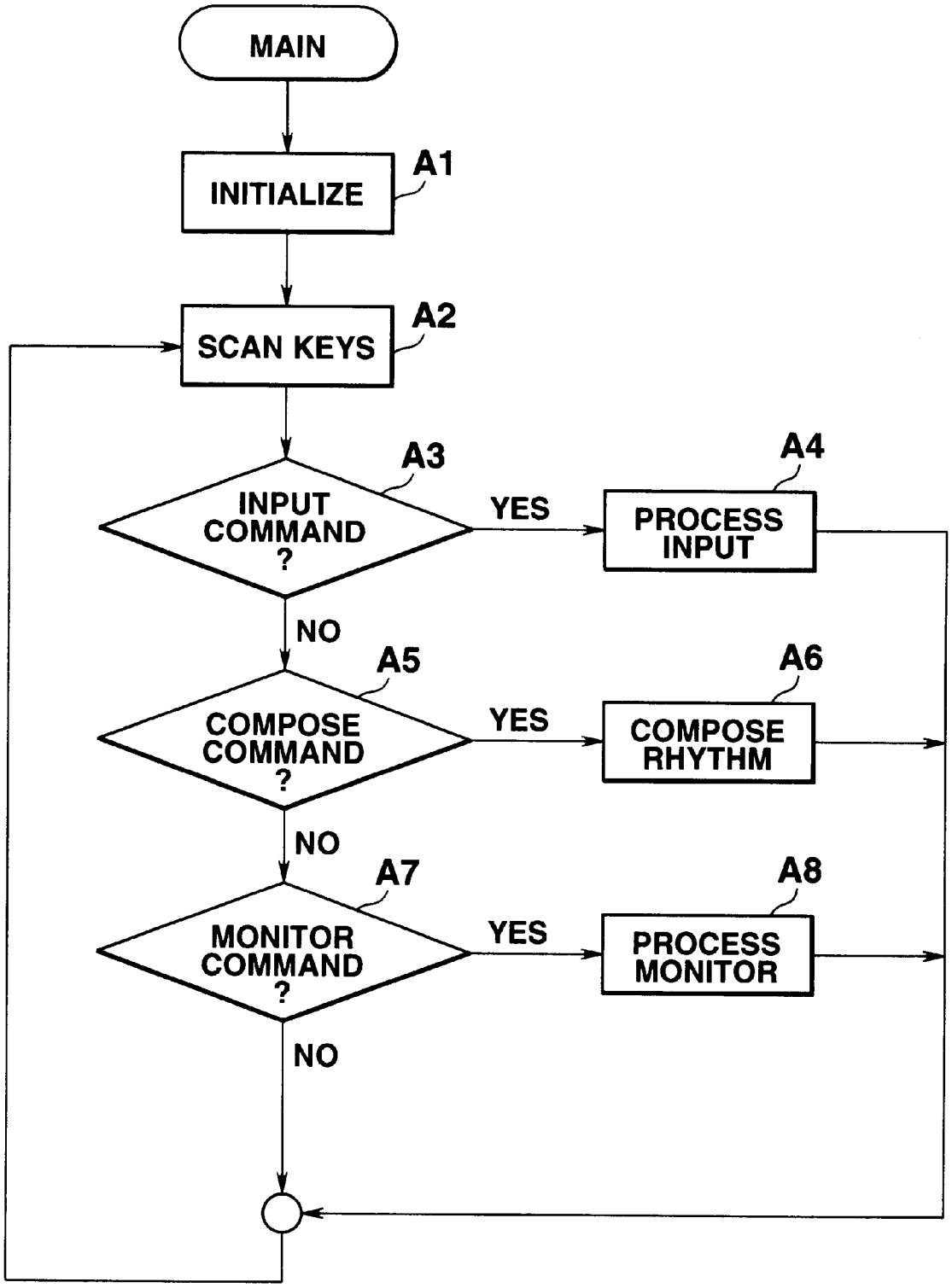
FIG. 2 is a flow chart showing an overall operation of the rhythm composer in accordance with the invention.

FIG. 2 is a main flow chart showing the overall operation of the rhythm composer. After initializing the system (A1), CPU 1 periodically scans keys of the input device 4 (A2) and performs a process according to a command from a user (A3 to A8). Specifically, in response to an input command, it processes the input (A4). For a compose command, (A5), a compose rhythm routine A6 is invoked whereas a process monitor routine A8 is executed in response to a monitor command (A7).

Figure 3:
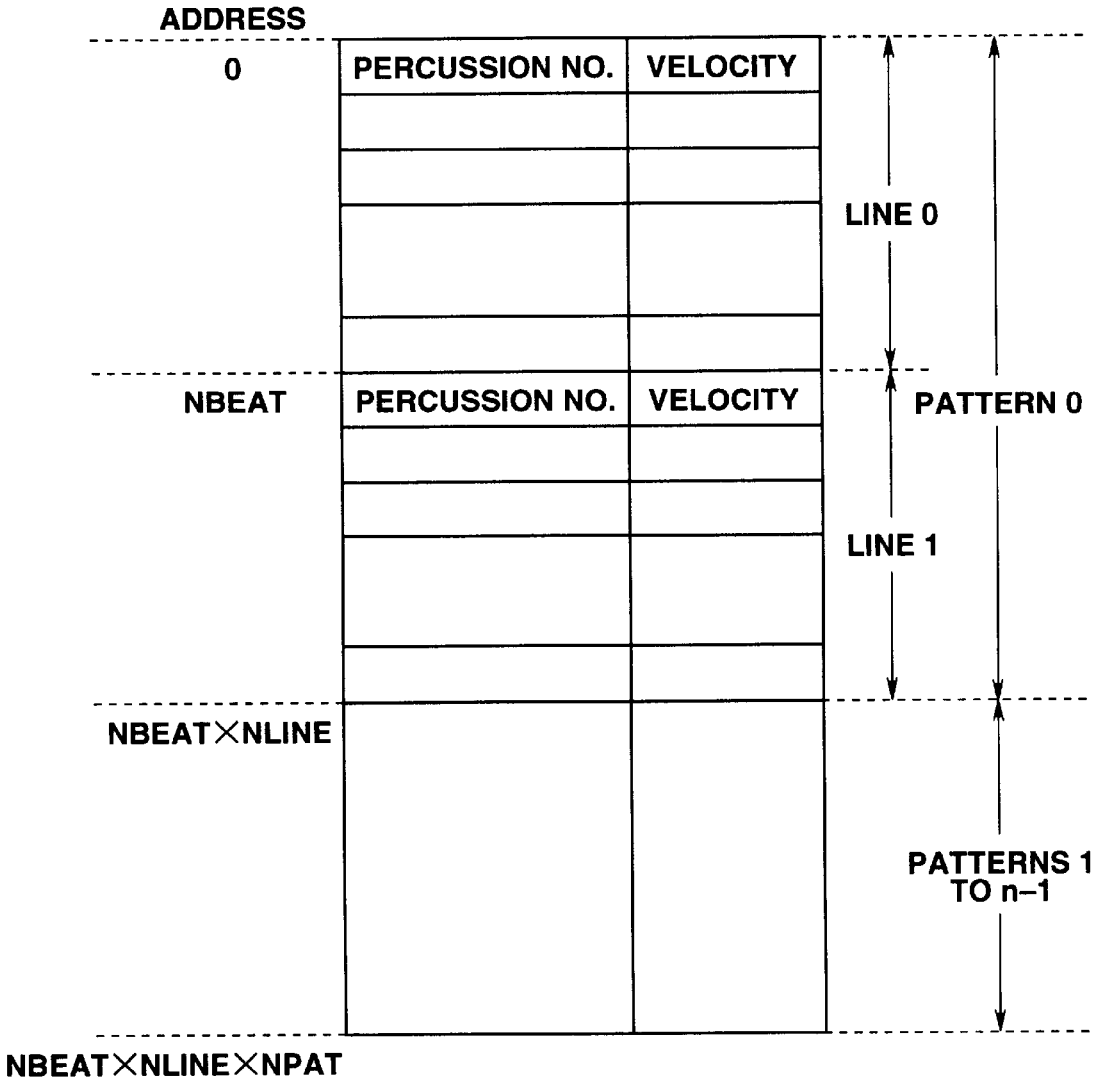
FIG. 3 illustrates a data structure of a rhythm population.

FIG. 3 shows a data structure of a rhythm population. The entirety of the rhythm population comprises a plurality of rhythms (i.e., individual rhythms). The individual rhythms are called rhythm patterns or simply patterns in FIG. 3. Each rhythm (pattern) comprises a plurality of rhythm lines (or simply called lines in FIG. 3). Each rhythm line is represented by a data array of percussion numbers and velocities (tone strength) for respective timings (beat points). Thus, the data array indicates a time sequence of percussion numbers with velocities at respective timings. In FIG. 3, NPAT indicates the number of rhythms (patterns) of the rhythm population, NLINE indicates the number of lines of each pattern and NBEAT indicates the number of timings (beat points) of each line. In the memory map of the rhythm population data structure shown in FIG. 3, a beat point (beat) of a line (line) of a pattern (pat) is located at the address of "pat*NLINE*NBEAT+line*NBEAT+beat." The data (percussion number and velocity) at the beat point is denoted by dat[pat][line][beat].

Figure 4:
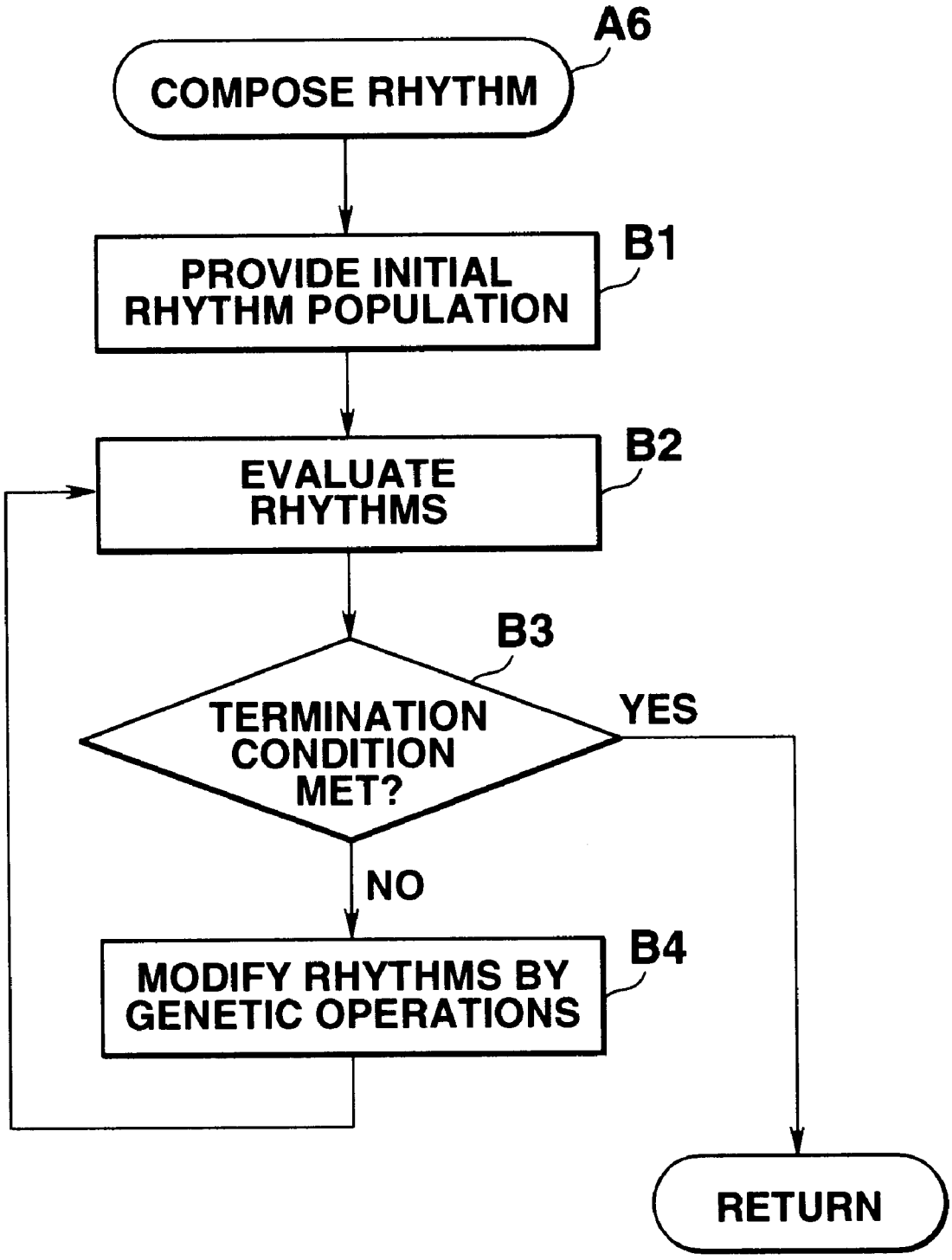
FIG. 4 is a flow chart of evolution-based rhythm composition involving genetic operations on the rhythm population in accordance with the invention.

FIG. 4 is a flow chart of the compose rhythm routine A6 in accordance with the invention.

At the beginning, a rhythm population of an initial generation is provided (B1). The initial rhythm population may be entered from a user, or preset in the system.

Block B2 evaluates individual rhythms of the rhythm population. The evaluate rhythms routine B2 will be described later in more detail.

Block B3 checks if a termination condition is met for the rhythm population. In the negative, the modify rhythms block B4 performs genetic operations on the rhythm population, thus generating the next generation of rhythm population.

The terminating condition test block B3 may be realized by either a repeat count test for checking if the genetic operations B4 have been repeated a predetermined number of times, or a rhythm fitness test for checking if the fitness valuation of the rhythm population of interest has exceeded a predetermined value.

The genetic operations of the modify rhythms block B4 are now described in detail.

Figure 5:
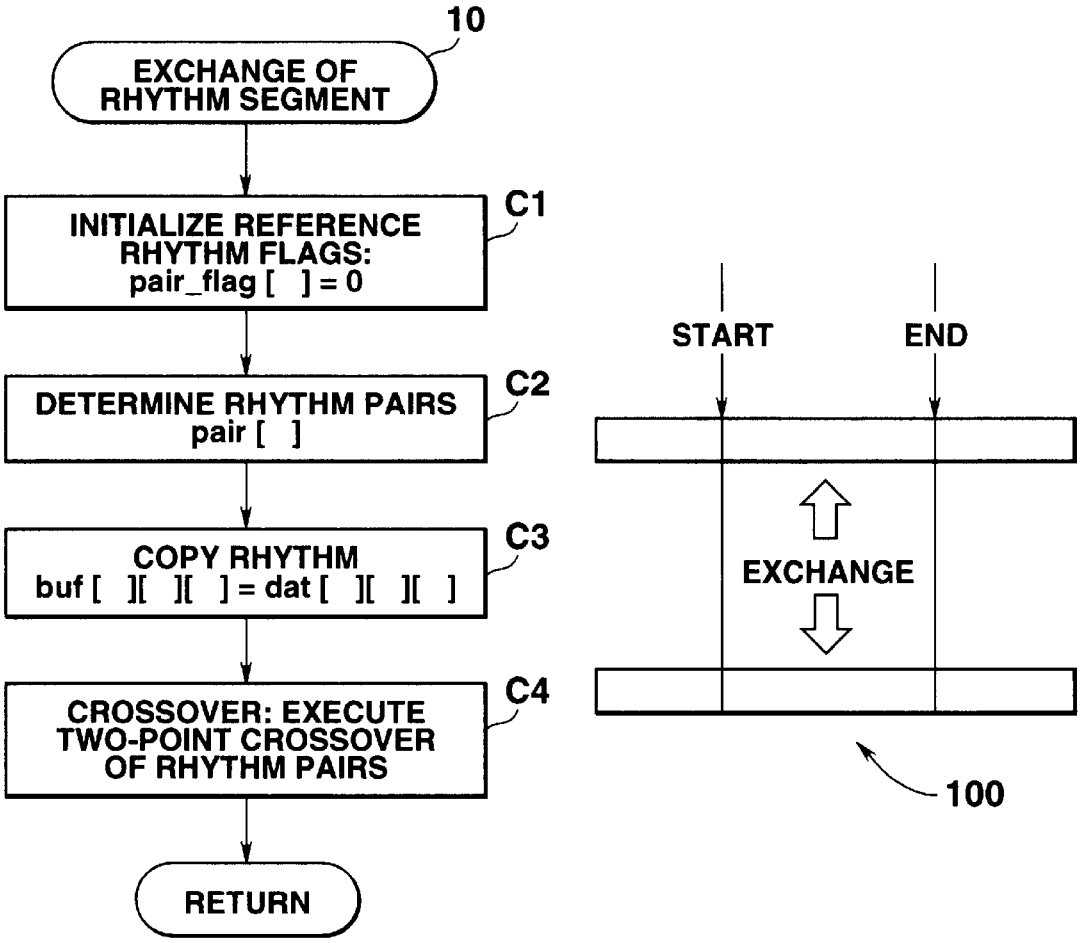
FIG. 5 is a flow chart of an exchange of rhythm segments routine as part of the genetic operations in accordance with the invention.

FIG. 5 is a flow chart of an exchange rhythm segments routine as part of the genetic operations B4. The rhythm segment exchange routine selects from the rhythm population of interest rhythm pairs, one pair at a time, and performs crossover of the rhythm pair (exchange of rhythm segments) between corresponding rhythm lines, as designated by reference numeral 100. The illustrated crossover 100 is a two-point crossover. This is not limitative and any other suitable crossover can be performed in accordance with the invention.

For pairing rhythms the routine initializes reference rhythm flags pairflag [ ] to "0" (C1), and determines random rhythm pairs, one at a time (C2). Each time when having determined a rhythm pair, the block C2 turns on the corresponding reference rhythm flags so that they will not be selected again. Block C3 copies the rhythm population data into buffer buf [ ] [ ] [ ]. Then the crossover block C4 is executed to perform a two-point crossover of respective rhythm pairs.

Figure 6:
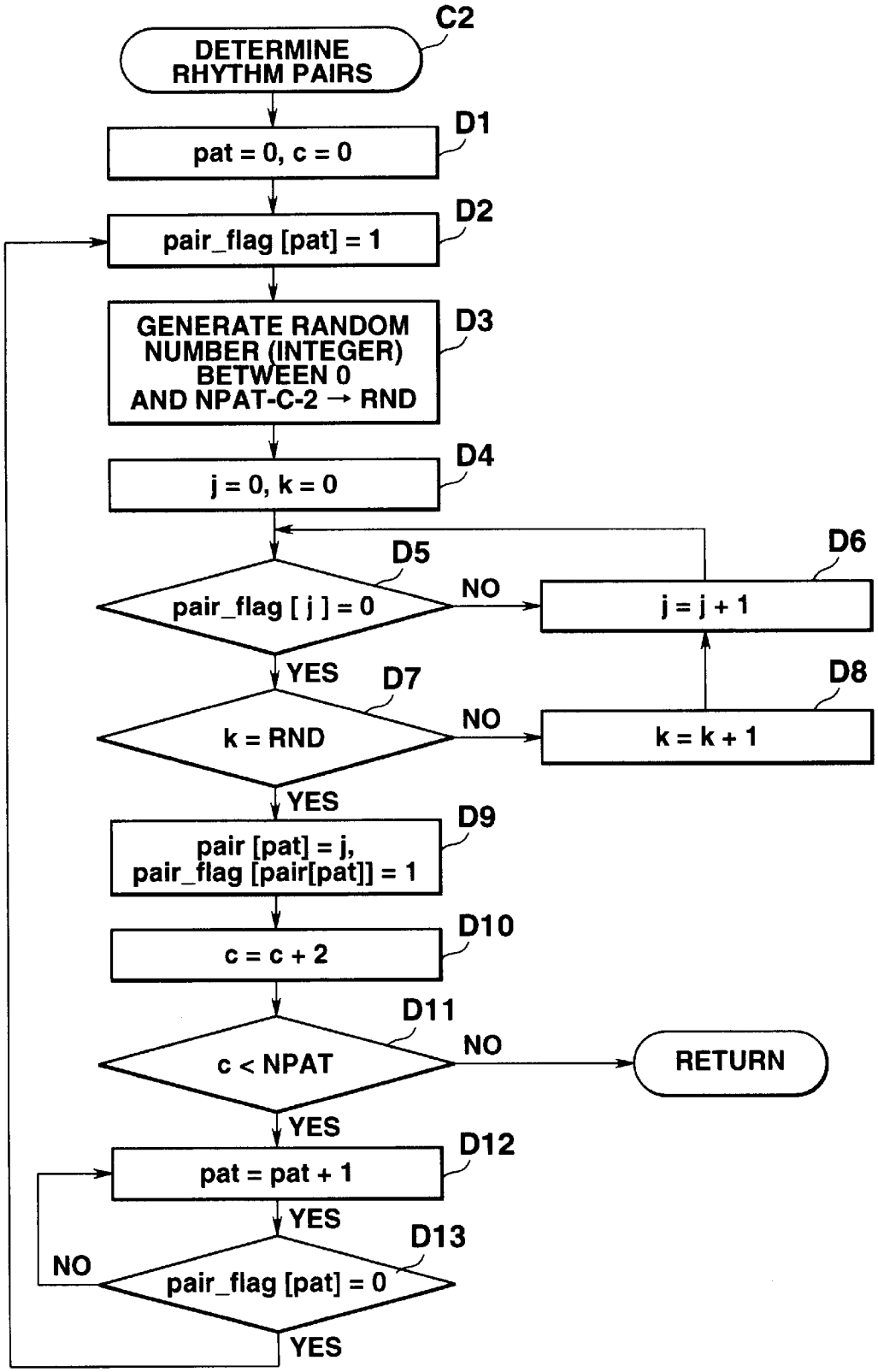
FIG. 6 is a flow chart of a determine rhythm pairs routine.

FIG. 6 is a detailed flow chart of the determine rhythm pairs block C2.

The entry block D1 initializes the rhythm pointer pat and counter c for counting rhythms that have taken part in rhythm pairing to "0". The block D2 turns on the current reference rhythm flag pairflag [pat] to "1". Then the determine rhythm pairs routine generates a random number RND (integer) between 0 and NPAT—C −2 and selects a rhythm corresponding to RND from those rhythms which have not yet been paired with their reference flags pairflag [ ] of "0"(D3–D8). The selected rhythm pair[pat] is a rhythm counterpart to be paired with the reference rhythm pat so that the selected rhythm flag pairflag[pair[pat]] is turned on (D9). Since a new pair of rhythms has been determined, the routine increments the counter c by 2 to see whether it has reached NPAT (D10, D11). If this is not the case, there still remain rhythms to be paired, so that the routine determines one of a rhythm pair, i.e., reference rhythm pat (D12, D13) and returns to the block D2.

Figure 7:
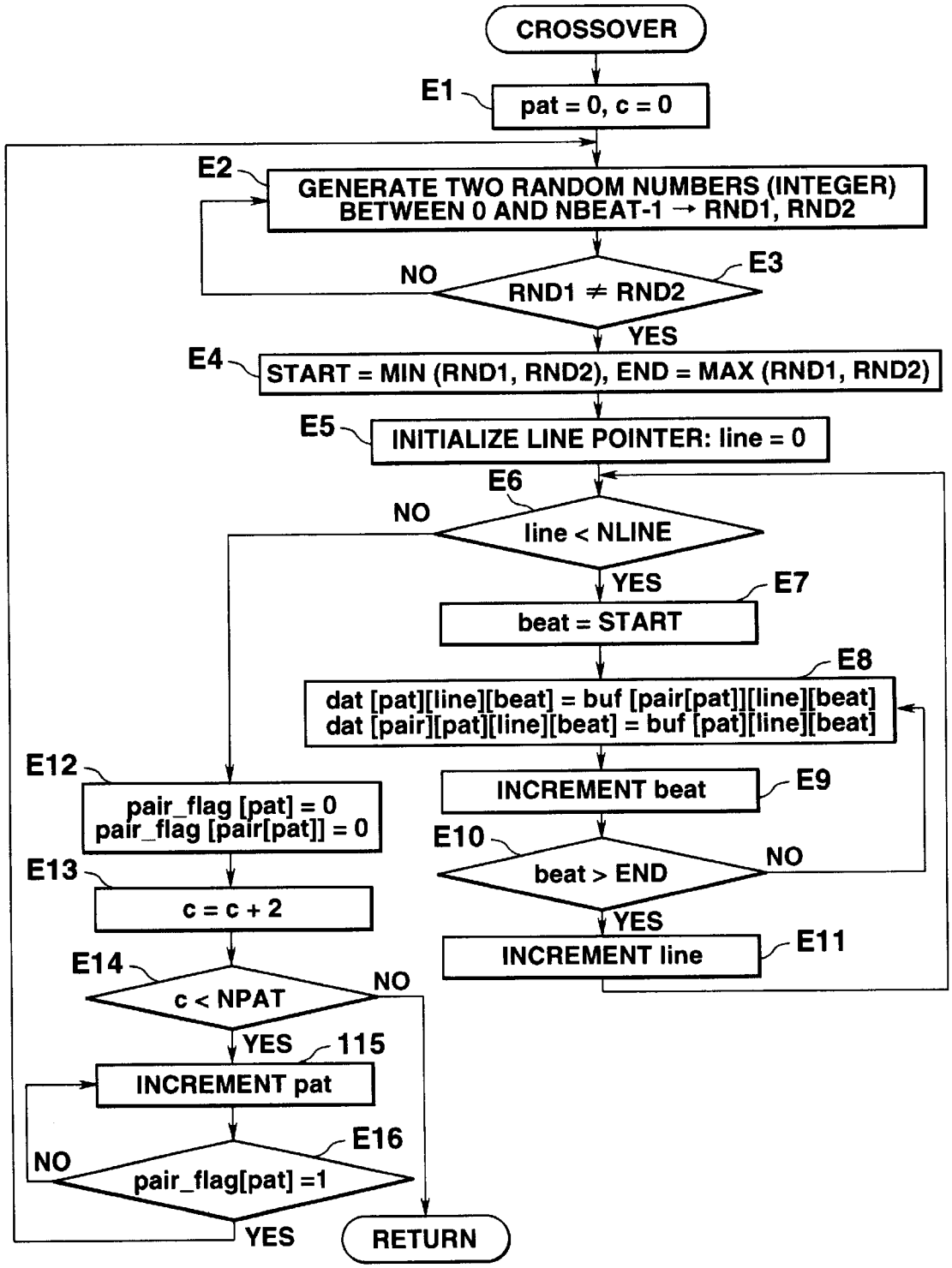
FIG. 7 is a flow chart of a crossover routine.

FIG. 7 is a detailed flow chart of the crossover routine C4.

At first, the routine initializes pat and counter c (used here for counting those rhythms which have undergone crossover) to "0" (E1), generates two different random numbers RND 1 and RND 2 between 0 and NBEAT −1, and selects the minimum of the random numbers as start point START of the crossover (exchange) and selects the maximum as the end point END of the crossover (E2–E4).

Then the routine initializes the rhythm line pointer line and performs exchange of rhythm line segment data of corresponding rhythm lines of the rhythm pair from START to END, using the buffer (E5–E11).

When the line pointer line has reached NLINE (E6), the two-point crossover has been completed with respect to a rhythm pair of interest. Thus the routine turns off the flags of the rhythm pair to "0" (E12), increments the counter c by 2 (E13), and checks if all rhythm pairs have undergone crossover (E14). If there still remains a rhythm pair to undergo crossing over, the routine selects the next reference rhythm pat (E15, E16) and returns to the block E2.

Figure 8:
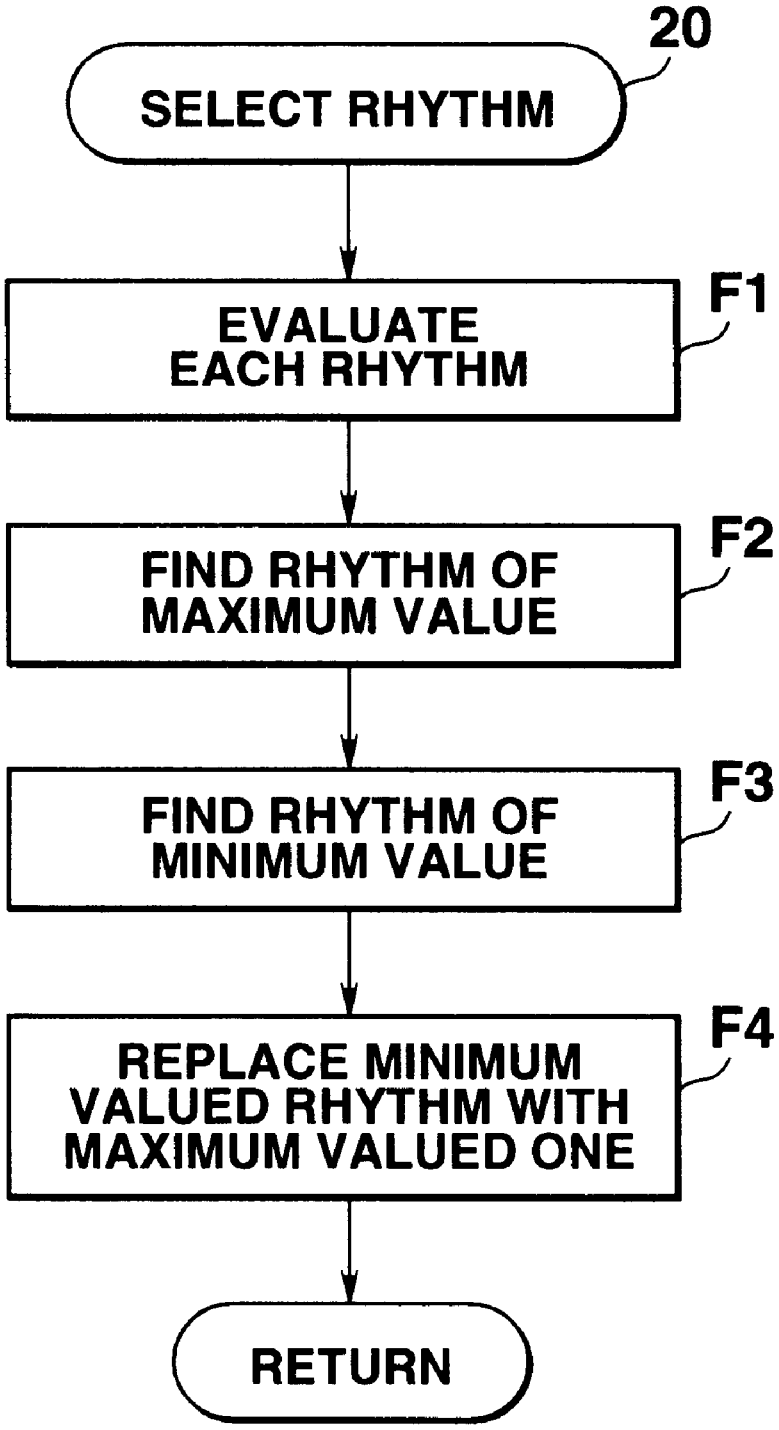
FIG. 8 is a flow chart of a select rhythm routine as part of the genetic operations.

FIG. 8 is a flow chart of select rhythm routine 20 executed in the genetic operations block B4. This select rhythm routine 20 may preferably be executed after the rhythm crossover, such as the one 10 shown in FIG. 5, but could be performed at any stage of the genetic operations B4. In the following, it is assumed that the select rhythm routine is executed after the rhythm crossover.

In this case, the block F1 evaluates individual rhythms of the rhythm population generated by the rhythm crossover.

The block F2 finds an individual rhythm of the maximum valuation whereas the block F3 finds an individual rhythm of the minimum valuation. Then the block F4 replaces the minimum valued rhythm individual rhythm with the maximum valued one.

In place of a single maximum or minimum valued individual rhythm, a plurality of higher and lower valued rhythms, for instance, the first to N-th highest valued rhythms and first to N-th lowest valued rhythms are looked up to replace such lower or lowest valued individual rhythms with such higher or highest valued individual rhythms.

The incorporation of the select rhythm routine 20 into the genetic operations block B4 will cause a descendent rhythm population to have a decreased number of lower valued individual rhythms and an increased number of higher valued individual rhythms. Thus, the rhythm valuation or fitness of the rhythm population will generally get higher through generations by repeating the genetic operations B4.

With the rhythm segment exchange strategy 10, each and every individual rhythm of the rhythm population of interest is equally selected to undergo crossing over.

In the alternative or in combination, another selection strategy, called value-dependent rhythm selection strategy may be adopted. For instance, the higher valued individual rhythm of the rhythm population of interest is controlled to get a higher chance or frequency of crossing over.

Figure 9:
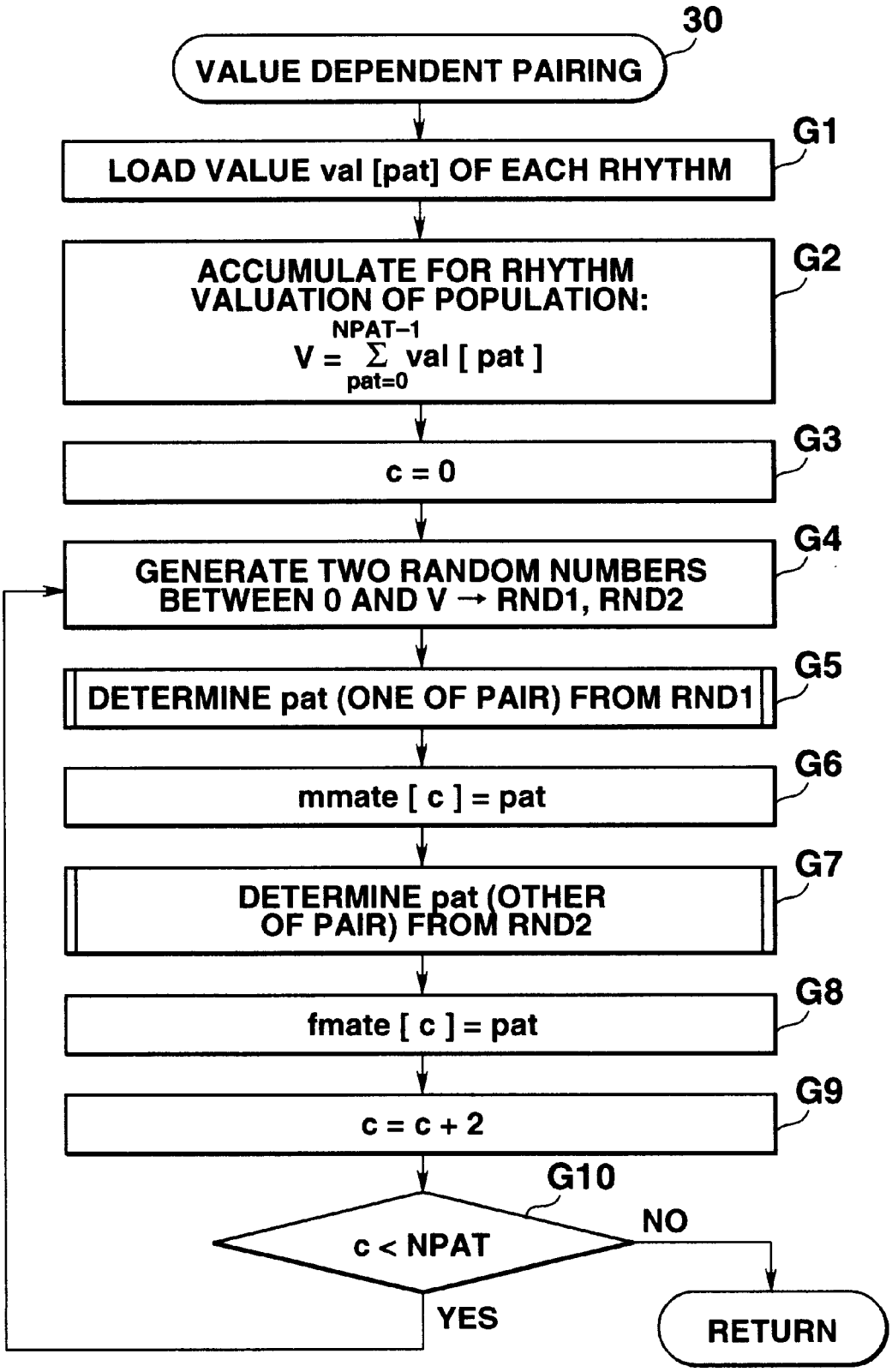
FIG. 9 is a flow chart of a value-dependent pairing routine for selecting from the population rhythm pairs for crossover according to their rhythm valuations.

FIG. 9 illustrates a flow chart of the value-dependent pairing, designated 30.

The first block G1 loads the valuation val [pat] of respective individual rhythms. The block G2 accumulates them to get the rhythm valuation of the population. Block G3 initializes the rhythm counter c to "0" for counting rhythms that have been paired or mated.

Then the routine generates two random numbers RND 1 and RND 2 (e.g., real numbers) between 0 and V (G4), determines from RND 1 one of a rhythm pair, pat, declares it mmate [c] (G5, G6), determines from RND 2 the other of the rhythm pair, pat, and declares it fmate [c] (G7, G8).

Figure 10:
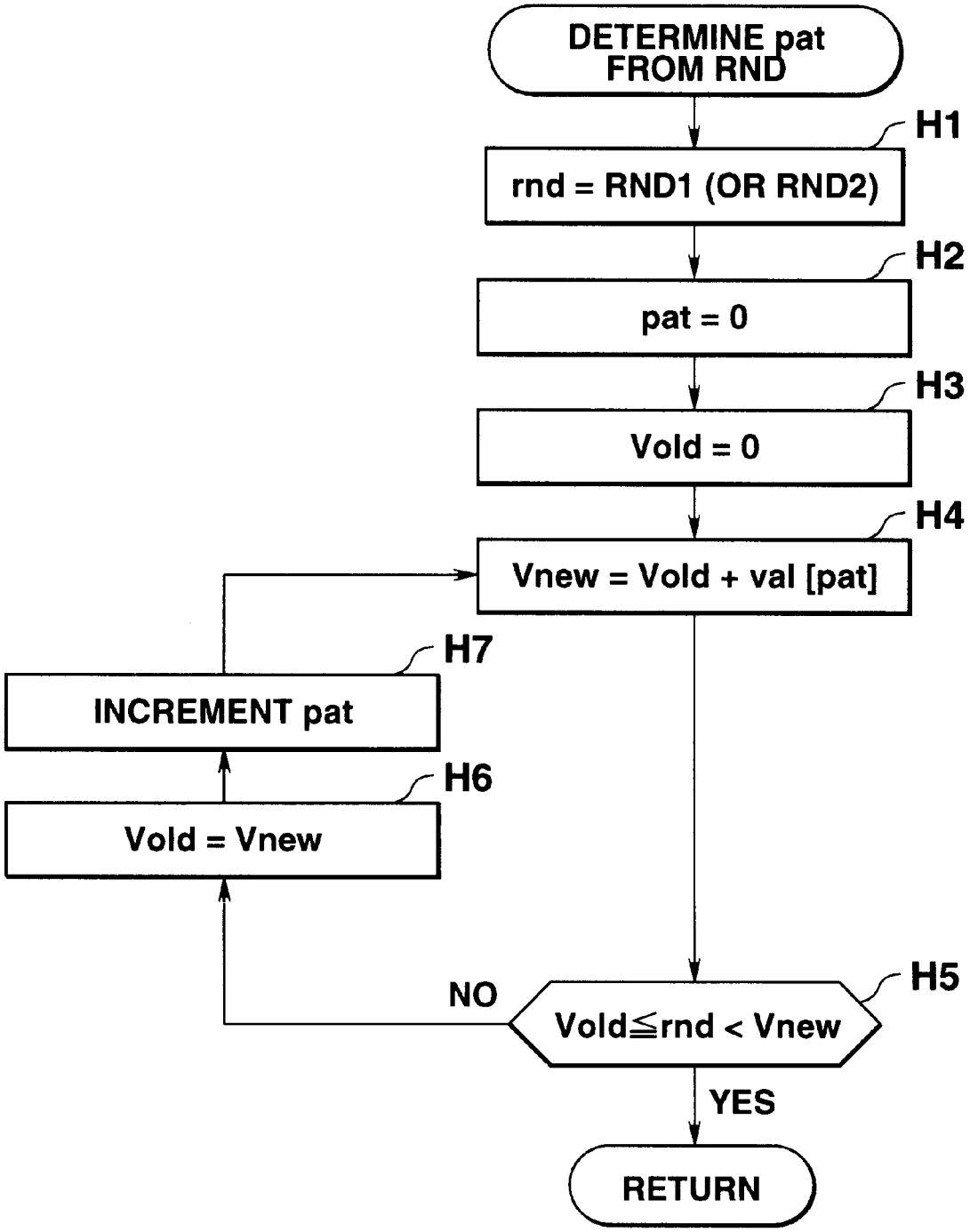
FIG. 10 is a flow chart of a routine for determining a rhythm (pat) from a random number.

FIG. 10 shows a detailed flow chart of the block G5 or G7 for determining an individual rhythm pat from the random number RND 1 or RND 2. The first block HI sets RND 1 or RND 2 to rnd. Then, rhythm pointer pat and Vold are initialized to "0" (H2, H3). The block H4 computes Vnew by $$Vnew=Vold+val[pat].$$

The block H5 tests the random number rnd to see whether it is in the range between Vold and Vnew, i.e., $$Vold \leq rnd < Vnew.$$

In the affirmative, the process returns to the block G6 or G8. In the negative, the routine sets Vold to Vnew (H6), increments the rhythm pointer pat (H7) and returns to the block H4.

In this manner, the rhythm pointer pat is determined from the random number. The rhythm pointer pat satisfies the following condition:

$$\sum_{j=0}^{pat-1} val[j] \leq rnd < \sum_{j=0}^{pat} val[j]$$

in which the term $$\sum_{j=0}^{pat-1} val[j]$$

is 0 for pat=0

Turning back to FIG. 9, the block G9 increments the rhythm counter c by 2. Block G10 checks if there still remains rhythms to be paired. If this is the case, the routine returns to the block G4.

In this manner, the value-dependent paring block 30 controls selection of individual rhythms of the population in such a manner that an individual rhythm will take part in pairing as either mmate[ ] or fmate [ ] for crossover with a chance or frequency in proportion to its rhythm valuation val [pat].

Figure 11:
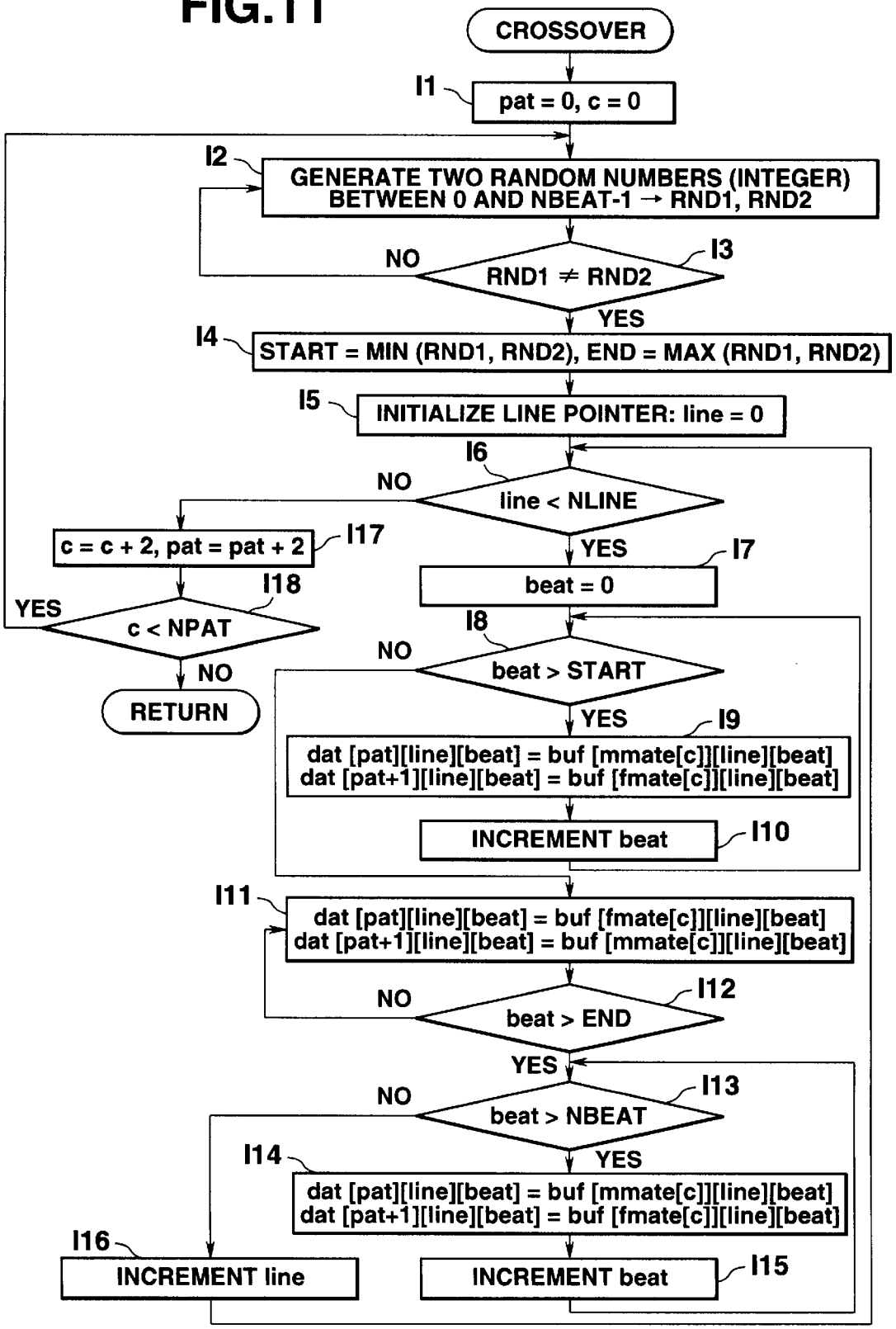
FIG. 11 is a flow chart of a crossover routine for performing crossover of the selected rhythm pairs.

FIG. 11 shows a flow chart of a crossover routine to be executed after the value-dependent paring 30. The rhythm data of the population are copied into the buffer (as done in the block C3 in FIG. 5) before the crossover process of FIG. 11.

The block I1 initializes pat and c to "0".

Then the routine generates two different random numbers RND1 and RND2 (integer) between 0 and NBEAT −1, uses the lower one as the start point START of the crossover and uses the higher as the end point END of the crossover (I2–I4) .

At the block I5 to I16, the routine performs exchange of rhythm segment data between corresponding rhythm lines of the rhythm pair mmate [c] and fmate [c], and stores the result as dat [pat] [line] [beat] and dat [pat+1] [line] [beat]. The rhythm segment of each line to be exchanged covers a beat point area (time interval) from the start point START to the end point END.

Specifically, when the beat point beat satisfies:

$0 \leqq beat < START$, or $END < beat \leqq NBEAT - 1$, the routine executes the data transfer of:

dat [pat] [line] [beat]=buf [mmate[c]] [line] [beat], and dat [pat+1] [line] [beat]=buf [fmate [c]] [line] [beat].

Thus, the buffer data at the location of pattern mmate [c], rhythm line line and beat point beat is loaded into the rhythm population memory as the data dat [pat] [line] [beat] at the location of rhythm pattern pat, rhythm line line and beat point beat, whereas the buffer data at location of fmate[c], line and beat is loaded into the rhythm population memory as the data dat [pat+1] [line] [beat] therein at the location of rhythm pattern (pat+1), rhythm line line and beat point beat (I7–I10, I13–I15).

On the other hand, when the beat point beat satisfies;

$START \leqq beat \leqq END$, the routine executes the data transfer of:

dat [pat] [line] [beat]=buf [fmate[c]] [line] [beat], and dat [pat+1] [line] [beat]=buf [mmate [c]] [line] [beat].

Thus, not mmate [c] but fmate [c] supplies the data dat [pat] [line] [beat] whereas not fmate [c] but mmate[c] supplies the data dat [pat +1] [line] [beat]. In doing so, exchange of rhythm segments is performed.

When parent rhythm pair mmate [c] and fmate [c] have completed crossover, i.e have generated a rhythm pair of children, then the block 16 finds line=NLINE. The block 117 increments c and pat by 2. The block I18 checks if all pairs have completed crossover (c=NPAT). In the negative, the routine returns to the block I2.

As a result of the value-dependent pairing 30 and crossover 40 of rhythm pairs, those individual rhythms of the parent population having the higher rhythm valuation spread out their genes (rhythm elements) the more into a rhythm population of child generation. Thus, a child or descendent rhythm population will get a higher rhythm valuation.

Figure 12:
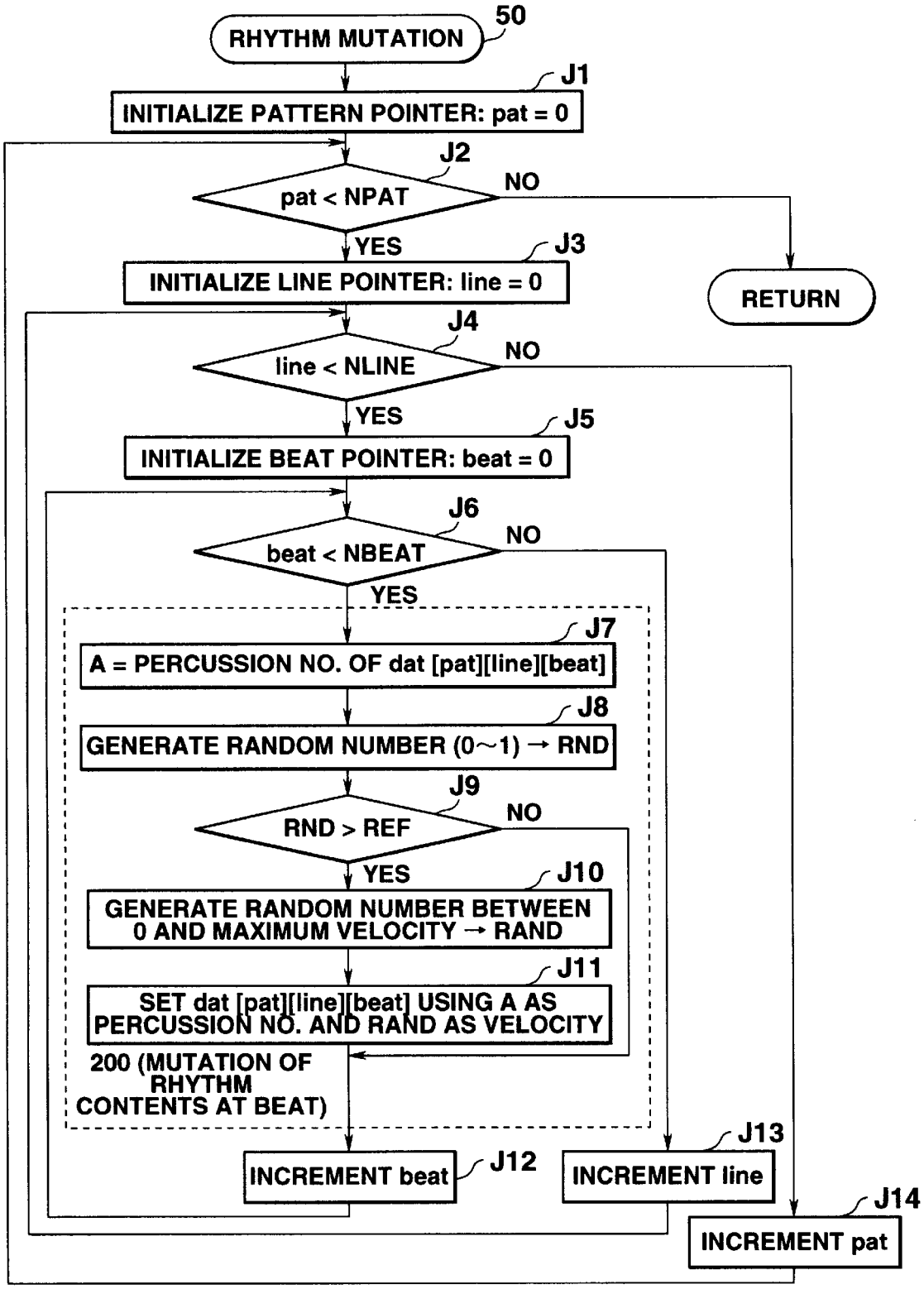
FIG. 12 is a flow chart of a rhythm mutation routine as part of the genetic operations.

FIG. 12 shows a flow chart of a rhythm mutation routine 50 executed as part of the genetic operations B4. The rhythm mutation 50 may be performed at any stage in the genetic operations B4.

The rhythm mutation routine 50 stochastically changes data of a beat point of a line of an individual rhythm. In the example of FIG. 12, the velocity of beat point changes by chance whereas the percussion number of beat point will not change.

The block J1 initializes the rhythm pointer pat to "0". Then, the routine performs a loop of J2–J14 until pat has reached NPAT (J2). The block J3 initializes line pointer line to "0". The loop of J4–J13 repeats until line has reached NLINE (J4). The condition of line=NLINE causes incrementing rhythm pointer pat (J14). The block J5 initializes the beat pointer beat to "0". Then, the inner loop of J6–J12 repeats until beat has reached NBEAT (J6). When beat=NBEAT, the line pointer line is incremented (J13).

The blocks J7 to J11 constitute mutation of rhythm contents of beat or time point beat, designated 200. At blocks J7 and J8, the routine saves the percussion number of data [pat] [line] [beat] into A and generates a random number RND (e.g., real number between 0 and 1). If the random number RND has not exceeded a predetermined probability or threshold REF (J9), no mutation occurs. If RAND>REF, the routine generates a random number RAND (e.g., integer) between 0 and the maximum possible velocity (J10), and sets dat[pat] [line] [beat], using A as percussion number and RAND as velocity (J11).

After the mutation 200 of beat point data, the routine increments the beat pointer (J12) and returns to the block J6.

Let us describe the rhythm evaluation.

Figure 13:
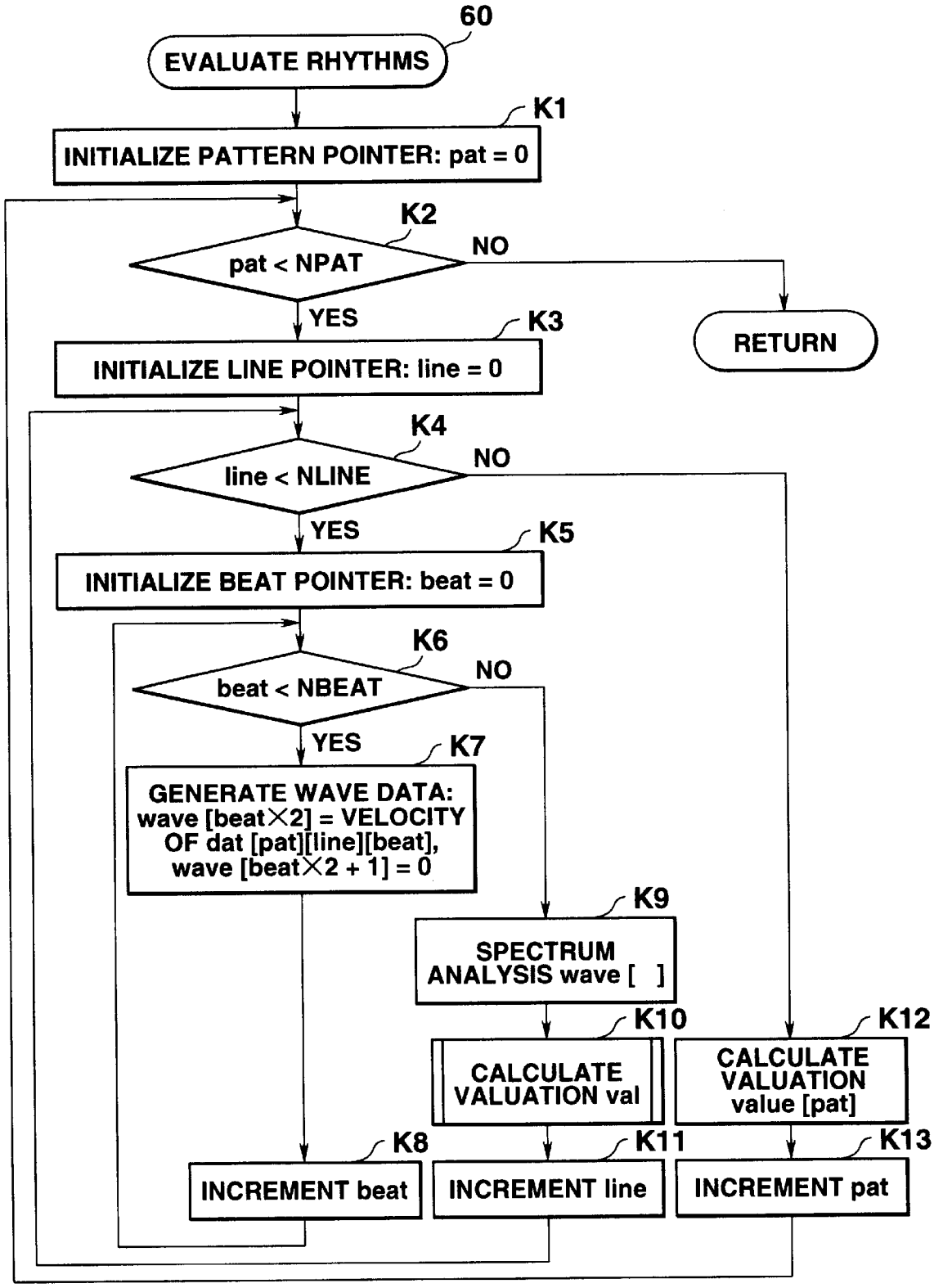
FIG. 13 is a flow chart of an evaluate rhythm routine for evaluating individual rhythms of a rhythm population.

FIG. 13 is a flow chart of the evaluate rhythms routine 60 for evaluating an individual rhythm pat of the population according to a predetermined evaluating function of fitness to get a valuation value [pat]. This routine 60 is invoked in the block B2 in FIG. 4 or block F1 in FIG. 8.

The blocks K1–K5 correspond to J1–J5 in FIG. 12 for initializing pointers and checking them. When beat<NBEAT is found in K6, a current rhythm element data (percussion number and velocity) dat[pat] [line] [beat], has been located and specified by the current rhythm pointer pat, line pointer line and beat pointer beat.

Thus, so long as beat meets the condition of beat=0 to NBEAT −1, the routine generates wave data indicative of a time sequence of velocities (K7, K8) by:

wave [beat*2]=velocity of dat [pat] [line] [beat], wave [beat*2+1]=0.

Since the wave date array wave [ ] can be displayed by the monitor 5, "0" (wave [beat*2+1]=0) is inserted between velocity samples for visual presentation.

When wave data covering a complete line has been generated, beat satisfies beat=NBEAT so that the routine will evaluate that rhythm line.

To this end, the illustrated routine performs spectrum analysis K9 at first.

Figure 14:
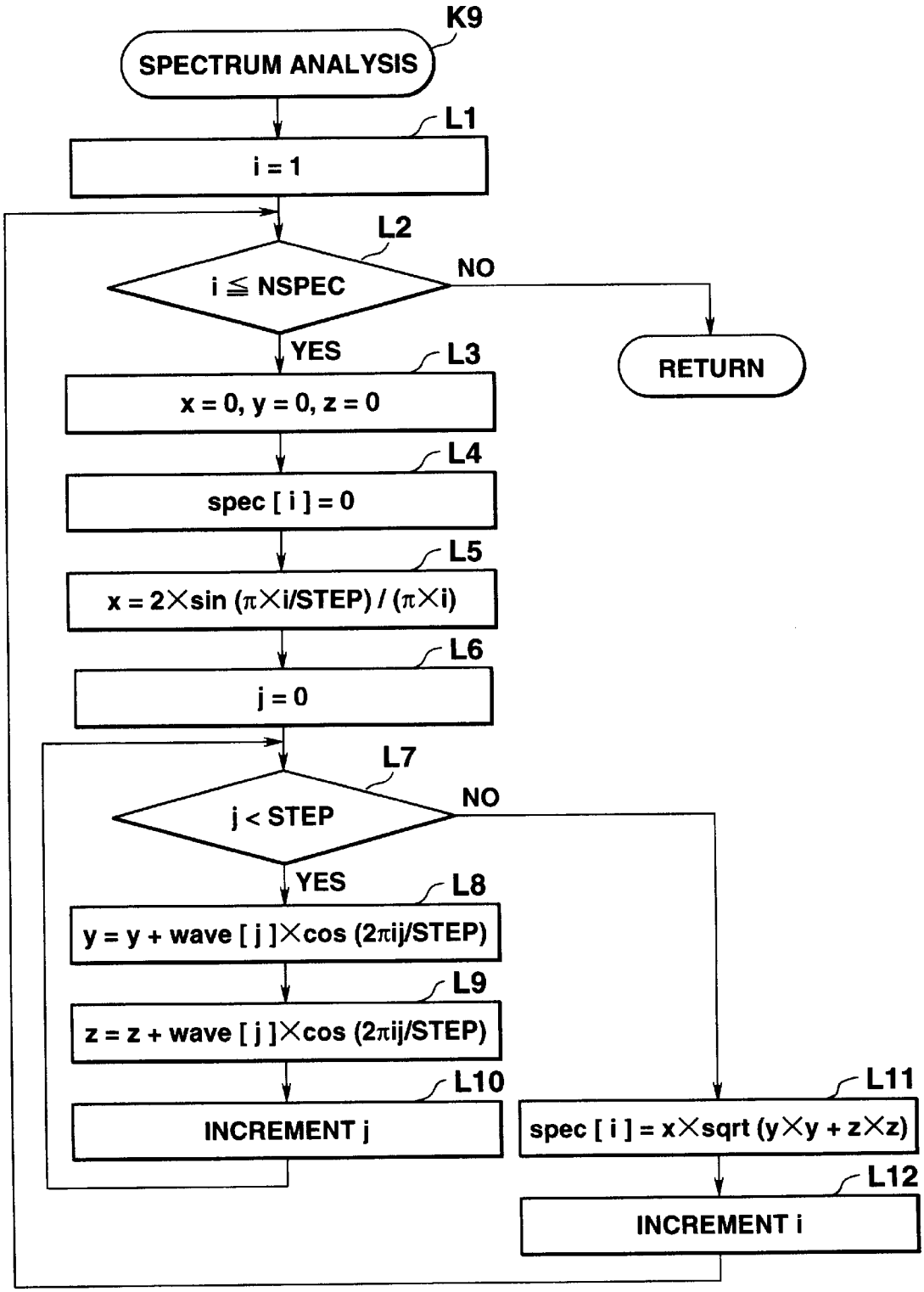
FIG. 14 is a flow chart of a spectrum analysis routine for analyzing a rhythm for frequency spectra.

FIG. 14 shows a flow chart of the spectrum analysis K9, designated by L1 to L12. According to the flow, the spectrum spec [i] of the order i is given by:

$$spec[i] = x\sqrt{(y^2 + z^2)}$$

in which $$x = 2\sin(\pi i / STEP) / \pi i,$$

$$y = \sum_{j=1}^{STEP-1} wave[j]\cos(2\pi ij / STEP),$$

$$z = \sum_{j=0}^{STEP-1} wave[j]\sin(2\pi ij / STEP), \text{ and}$$

$$STEP = 2NBEAT.$$

In place of this, conventional DFT (Discreet Fourier Transformation) may be adopted. According to the above formula, respective DFT coefficient powers are multiplied by Fourier coefficients of a square wave, thus obtaining frequency components spec [i] of a waveform obtained by holding and interpolating between wave samples wave [ ].

Turning back to the rhythm evaluation flow of FIG. 13, the block K10 evaluates a current rhythm line. In a specific embodiment, this process K1O calculates (1) spectrum fitness valuation, (2) phase fitness valuation or (3) sum or combination of spectrum and phase fitness valuations. A desired calculation mode of the process K10 may be chosen by the input device 4.

Figure 15:
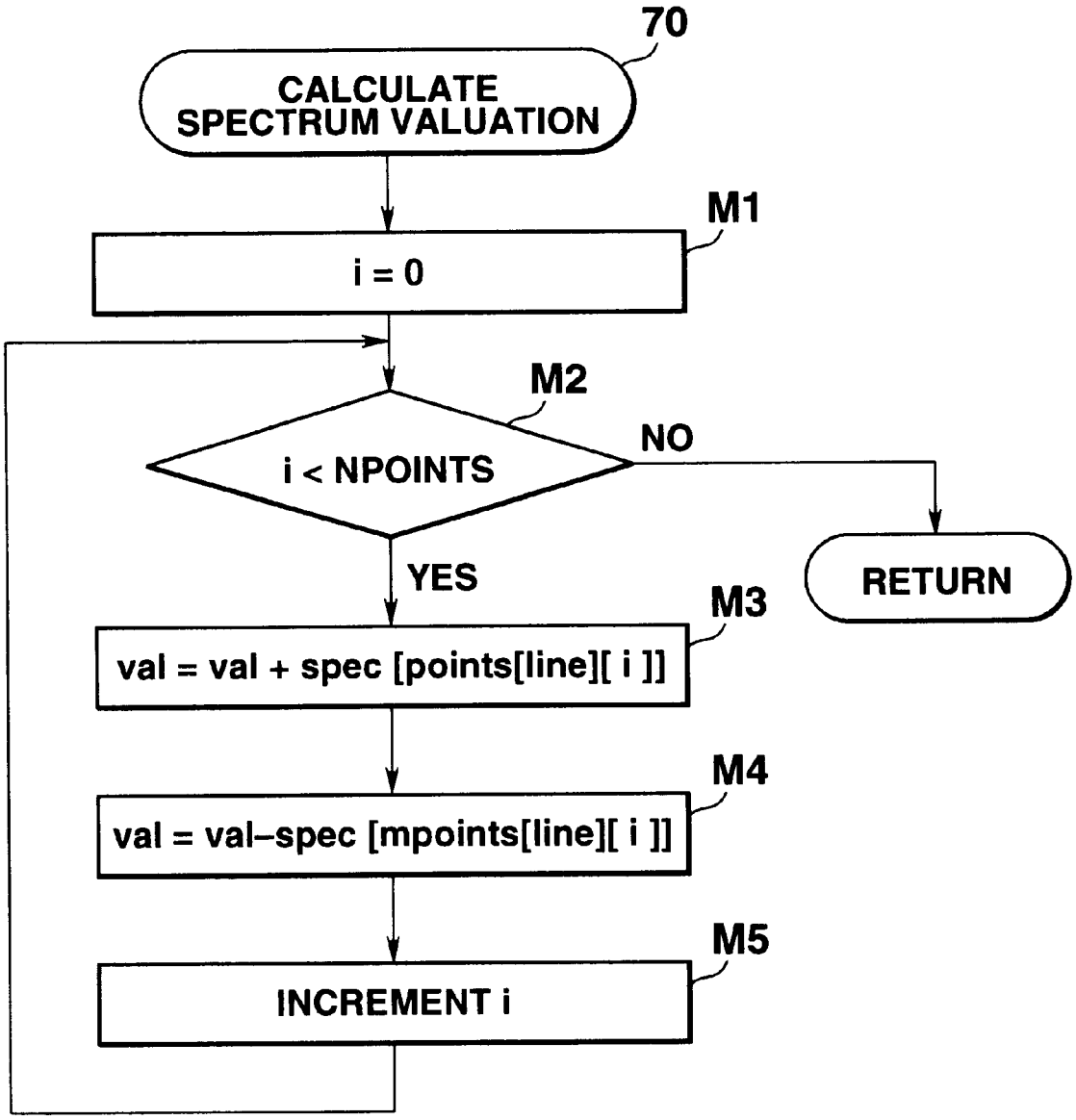
FIG. 15 is a flow chart of a calculate spectrum evaluation routine for calculating a spectrum fitness valuation of a rhythm.

FIG. 15 shows a flow chart of the calculate spectrum valuation routine, designated 70. This routine uses the result of the spectrum analysis (see FIG. 14), such as spectrum data spec[ ] to evaluate fitness of a rhythm line in terms of frequency.

In the flow of M1 to M5, points [line] [i] and mpoints [line] [i] are conditioning parameters for spectrum evaluation. These conditioning parameters have been set and entered by the input device 4 via the input process A4. The points [line] [i] duplicably denote spectrum numbers (orders) of spectrums to be added to the valuation of each line whereas the mpoints [line] [i] duplicably denote spectrum numbers or orders of spectrums to be subtracted from the valuation of each line. For example, for line=0, spectrums of orders 16, 8 and 16 are chosen to be added to the valuation whereas spectrums of orders 2, 4 and 1 are chosen to be subtracted from the valuation. For a line (e.g., line=1) other than line=0, independent or different choice of orders can be made.

Using the conditioning parameters points [ ] [ ] and mpoints [ ] [ ] the spectrum fitness valuation val of a rhythm line is given by the evaluating function of:

$$val = \sum_{i=1}^{NSPEC} c[i] * spec[i]$$

in which spec [i]=spectrum of the order i, c[i]=weighing coefficient of order i, which is positive, negative, or 0.

The conditioning parameters points [ ] [ ] and mpoints [ ] [ ] specify the value of c [i].

FIG. 16 illustrates an operation example of the spectrum fitness valuation routine 70 in FIG. 15. For simplicity, an individual rhythm (pattern) comprises two rhythm lines of first (line=0) and second (line=1). For the first line or line=0, the spectrum fitness evaluating function val0is given by:

val0=spec [16]+spec [8]+spec [16]−spec [1]−spec [2]−spec[4].

For the second rhythm line or line=1, the spectrum fitness evaluating function val1 is given by:

val1=spec [2]+spec [4]+spec [1]−spec [16]−spec [8]−spec [16].

The evaluating function vall is found symmetrical with the evaluating function val0 of the first rhythm line.

The sum of (val0 +val1) represents a fitness valuation of an individual rhythm (pattern=0) including the first line data dat [0] [0] [ ] and the second line data dat [0] [1] [ ] in terms of spectrum or frequency.

In the example of FIG. 16, rhythm line of line=0 represents a rhythm line of a percussion instrument or timbre corresponding to the percussion number 2*a* (hexadecimal notation) whereas the second rhythm line of line=1 represents a rhythm line involving percussion instruments or timbres specified by percussion numbers 24 and 28 (hexadecimal notation). In FIG. 16, terms (wave [ ], spec[ ], val0, val1 etc,) other than dat [ ] [ ] [ ] are indicated by decimal notation.

Figure 17:
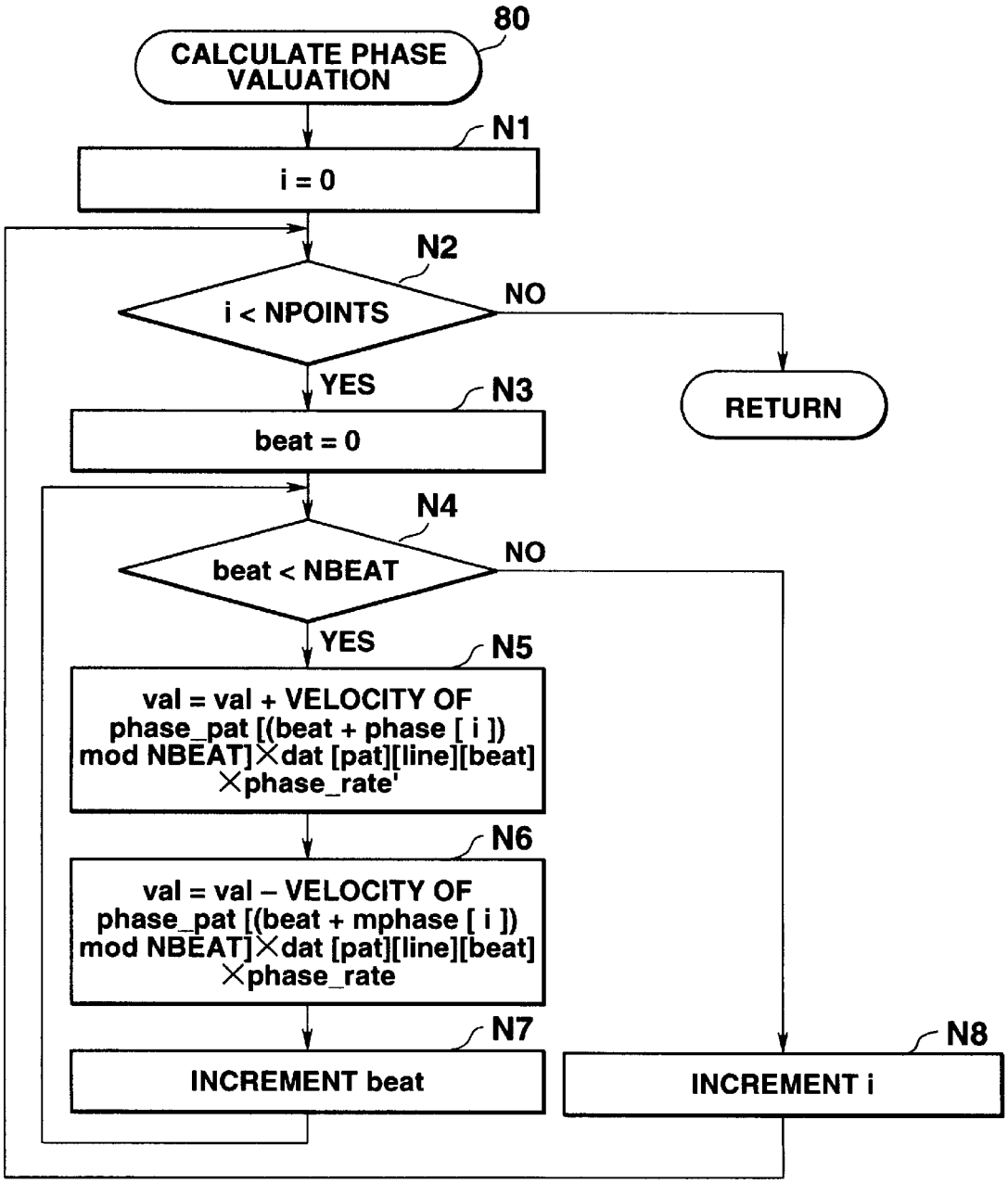
FIG. 17 is a flow chart of a calculate phase evaluation routine for calculating a phase fitness valuation of a rhythm.

FIG. 17 shows a flow chart of a calculate phase fitness valuation routine 80 for calculating a rhythm fitness valuation (phase valuation) of a rhythm line in terms of phase. FIG. 18 shows an operation example.

In the flow of N1–N8 of the routine 80, the terms phasepat [ ] phase [i], mphase [i] and phaserate are conditional parameters for phase evaluation. These conditioning parameters are set and entered by the input device 4 via the input process A4.

The conditioning parameter phase pat [ ] is a phase pattern. The phase pattern may be of the same length (same number of beat points) as a rhythm of interest, and has a pattern of weight data assigned to respective beat points (see FIG. 18).

As shown in block N5, the term of phasepat [(beat+phase [i]) mod NBEAT]*velocity of dat [pat][line][beat]*phaserate is added to the valuation val. On the other hand, the block N6 subtracts the term of:

phasepat [(beat+mphase [i]) mod NBEAT]*velocity of dat [pat] [line] [beat]*phaserate from the valuation val.

To match the rhythm data dat [ ] [ ] [beat ] against the phase pattern phasepat [ ], the parameter phase [i] is used as a phase conditioning parameter indicative of which position or phase of the phase pattern phasepat [ ] has to meet the start of the rhythm line dat [ ] [line] [beat]. If phase [0]=0, for example, the start (position 0) of the phase pattern phasepat [ ] meets the start (beat=0) of the rhythm line for the matching at the time of i=0. If the phase [1]=8 has been set, the position 8 of the phase pattern phasepat [ ] is to meet the start of the rhythm line for the matching at the time of i=1.

Like the parameter phase [i], mphase [i] specifies position (phase) of the rhythm line for matching against the phase pattern. It is noted, however, that phase [i] is used when calculating a term (matching degree) to be added to the fitness valuation whereas mphase [i] is used to calculate a term to be subtracted from the valuation.

In the example of FIG. 18, NPOINT=2, and mphase [0]=1 and mphase [1]=5. The parameters phase [ ] have been set as described.

The term phaserate is a rate parameter. In the example of FIG. 18, phaserate is set equal to 0.2.

According to the flow of FIG. 17, the phase valuation val is given by:

$$val = phaserate * \left( \sum_{j=0}^{NPOINTS-1} \sum_{beat=0}^{NBEAT-1} (phasepat[(beat + phase[i])\bmod NBEAT] * velocityofdat[pat][line][beat] - phasepat[(beat + mphase[i]\bmod NBEAT] * velocityofdat[pat][line][beat]) \right)$$

In this manner, the calculate phase valuation routine 80 uses the set condition or conditioning parameters and rhythm contents of dat [ ] [ ] [ ] to calculate a fitness valuation of the rhythm in terms of phase.

In the operation example of FIG. 18, phase valuation val0 of the rhythm line 0 (dat [0] [0] [ ]) is 143, phase valuation val1 of the rhythm line 1 (dat [0] [1] [ ]) is −11 and the phase valuation val of the rhythm (pattern 0) of lines 0 and 1 is computed as 131 (rounding ).

Turning back to the flow of the evaluate rhythms routine shown in FIG. 13, calculate valuation block K10 calculates the rhythm valuation of a rhythm line in the manner as described.

The routine increments the line pointer line (K11) and calculates the rhythm valuation of all rhythm lines of an individual rhythm (pattern) until line=NLINE. When line=NLINE, the block K12 accumulates the individual rhythm line valuations to get the rhythm valuation of the rhythm (pattern) pal. Then the routine increments the rhythm or pattern pointer pat (K13) and returns to the block K2. The routine repeats the process until all rhythms have been evaluated.

The calculate valuation block KIO may perform both spectrum valuation routine 70 and the phase valuation routine 80. If this is the case, the rhythm valuation val of a rhythm line may be computed from the spectrum valuation sval and phase valuation pval by:

$$val = sval + pval.$$

A rhythm fitness valuation val [pat] of a individual rhythm (pattern) may be computed from rhythm valuations val [line] of respective rhythm lines by:

$$val[pat] = \sum_{line=0}^{NLINE-1} val[line]$$

The following illustrates how rhythm valuation of a rhythm population changes through generations when the system repeats specific genetic operations (including processes of Figs.5 and 12) on the rhythm population with the population size of 8 i.e., eight individual rhythms each having two lines:

First generation's rhythm valuation=217.89
Second generation's rhythm valuation=268.71
Third generation's rhythm valuation=262.05
Fourth generation's rhythm valuation=328.14
Fifth generation's rhythm valuation=356.65
Sixth generation's rhythm valuation=322.45
Seventh generation's rhythm valuation=383.59
Eight generation's rhythm valuation=359.61
Ninth generation's rhythm valuation=376.44
Tenth generation's rhythm valuation=437.10

As in the specific example, it has been found that the fitness valuation of the rhythm population (given by the sum or average of valuations of individual rhythms) generally increases with generations though it can locally or temporarily decrease.

This concludes the detailed description of preferred embodiments. However, various modifications will be obvious to those skilled in the art within the scope of the invention.

For instance, the described conditioning parameters for rhythm evaluation are only illustrative. In particular, whereas the rhythm fitness evaluation has been described in terms of frequency (spectrum) and phase, other components may also be used to evaluate rhythms.

What is claimed is:

1. An apparatus for composing a musical rhythm, comprising:

(A) initial rhythm generation providing means for providing an initial generation rhythm population comprising a plurality of individual rhythms;

(B) rhythm evolving means for repeatedly generating a new generation rhythm population from a preceding generation rhythm population, beginning with the initial generation rhythm population;

(C) said rhythm evolving means comprising (i) rhythm evaluating means for evaluating the individual rhythms of a rhythm population of interest according to a predetermined evaluating function to thereby determine a rhythm valuation, and (ii) genetic operations means for performing genetic operations on the rhythm population of interest in a manner such that the rhythm valuation will generally increase with each new generation rhythm population; and (D) stopping means for stopping operation of the rhythm evolving means when a predetermined terminating condition is met.

2. The apparatus of claim 1, wherein said genetic operations means comprises rhythm crossover means for exchanging rhythm segments between the individual rhythms of the rhythm population of interest.

3. The apparatus of claim 2, wherein said genetic operations means further comprises rhythm replacement means for receiving a resultant rhythm population from said rhythm crossover means, and means for replacing individual rhythms having a lower valuation with individual rhythms having a higher valuation.

4. The apparatus of claim 2, wherein said genetic operations means further comprises selection control means for controlling a selective crossover frequency of the individual rhythms of the rhythm population of interest in a manner such that the individual rhythms are selected to undergo crossover at a frequency which depends on respective rhythm valuations thereof.

5. The apparatus of claim 1, wherein said genetic operations means comprises mutation means for mutating an element of at least one of the individual rhythms.

6. The apparatus of claim 1, wherein said stopping means comprises means for stopping operation of the rhythm evaluating means when the rhythm valuation of the rhythm population of interest exceeds a predetermined value.

7. The apparatus of claim 1, wherein said rhythm evaluating means comprises:

(a) conditioning means for setting a condition of evaluation; and (b) calculating means for using the set condition to calculate rhythm valuations of the individual rhythms.

8. The apparatus of claim 1, wherein each individual rhythm comprises a plurality of rhythm lines each represented by a data array of percussion numbers, velocities and respective timings thereof.

9. The apparatus of claim 1, wherein said rhythm evaluating means comprises spectrum evaluating means for evaluating a frequency fitness an individual rhythm of interest.

10. The apparatus of claim 1, wherein said rhythm evaluating means comprises phase evaluating means for evaluating a phase fitness of an individual rhythm of interest.

11. A method for automatically composing a musical rhythm, comprising:

(A) providing an initial generation rhythm population comprising a plurality of individual rhythms;

(B) repeatedly generating a new generation rhythm population from a preceding generation rhythm population, beginning with the initial generation rhythm population;

(C) said repeated generation comprising (i) evaluating the individual rhythms of a rhythm population of interest according to a predetermined evaluating function to thereby determine a rhythm valuation, and (ii) performing genetic operations on said rhythm population of interest so that the rhythm valuation will generally increase with each new generation rhythm population; and (D) stopping the repeated generation when a predetermined terminating condition is met.

12. A method for automatically composing a musical rhythm, comprising:

(A) providing an initial generation rhythm population comprising a plurality of individual rhythms;

(B) providing conditioning parameters;

(C) evaluating a fitness of the individual rhythms of a rhythm population of interest based on the conditioning parameters;

(D) performing genetic operations on the rhythm population of interest, beginning with the initial generation rhythm population, based on a result of the evaluation to thereby generate a new generation rhythm population; and (E) repeatedly generating new generation rhythm populations until a predetermined terminating condition is met.

* * * * *